US009655423B1

(12) United States Patent
Wang

(10) Patent No.: US 9,655,423 B1
(45) Date of Patent: May 23, 2017

(54) CONTACT LENS PACKAGE

(71) Applicant: HON HAI PRECISION INDUSTRY CO., LTD., New Taipei (TW)

(72) Inventor: Jia-Ming Wang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/140,512

(22) Filed: Apr. 28, 2016

(51) Int. Cl.
*A45C 11/00* (2006.01)

(52) U.S. Cl.
CPC ..... *A45C 11/005* (2013.01)

(58) Field of Classification Search
USPC ..... 206/5, 5.1
See application file for complete search history.

(56) References Cited

U.S. PATENT DOCUMENTS 5,467,868 A * 11/1995 Abrams ..... A61F 2/1691 134/901
5,704,468 A * 1/1998 Lust ..... B65D 1/34 206/205
6,976,584 B2 * 12/2005 Maiola ..... A61F 2/0095 206/438
2002/0046958 A1 * 4/2002 Lipscomb ..... A45C 11/005 206/5.1
2003/0029736 A1 * 2/2003 Phillips ..... B65D 85/54 206/5.1
2004/0004008 A1 * 1/2004 Peck ..... A45C 11/005 206/5.1
2006/0213784 A1 * 9/2006 Tokarski ..... B65D 81/22 206/5.1
2006/0237335 A1 * 10/2006 Py ..... A45C 11/005 206/5.1
2007/0034533 A1 * 2/2007 Coldrey ..... B65D 75/366 206/5.1
2008/0011619 A1 * 1/2008 Newman ..... A45C 11/005 206/5.1
2008/0017525 A1 * 1/2008 Newman ..... A45C 11/008 206/5.1
2008/0023345 A1 * 1/2008 Tokarski ..... A45C 11/005 206/5.1
2008/0170201 A1 * 7/2008 Filippo ..... A61L 12/04 351/159.33
2009/0045080 A1 * 2/2009 O'Neill ..... B65B 7/2878 206/5.1
2009/0145091 A1 * 6/2009 Connolly ..... B65B 25/008 53/467
2012/0000797 A1 * 1/2012 Bowers ..... A45C 11/005 206/5.1
2012/0267262 A1 * 10/2012 Wang ..... A45C 11/005 206/5.1
2015/0114851 A1 * 4/2015 English ..... B65D 75/326 206/5.1

* cited by examiner

*Primary Examiner* — Jacob K Ackun
(74) *Attorney, Agent, or Firm* — Steven Reiss

(57) ABSTRACT

A contact lens package comprising a top plate, a receiving portion located at a first end of the top plate, and a holding portion located at a second end of the top plate opposite to the first end. The holding portion protrudes downward from the top plate. A holding surface is defined at an intersection of the holding portion and the top plate. The holding surface is an arc surface depressed from the intersection of the holding portion and the top plate.

11 Claims, 4 Drawing Sheets

CONTACT LENS PACKAGE

FIELD

The subject matter herein generally relates to a contact lens package.

BACKGROUND

Contact lenses, also known as ophthalmic lenses, are configured for vision correction or eye protection when resting on the eye in contact with the cornea or the sclera, or both. After being manufactured, the contact lens is usually placed into a package containing a storage solution. Then, the contact lens can withstand the requirements for storage and shopping.

BRIEF DESCRIPTION OF THE DRAWINGS

Implementations of the present technology will now be described, by way of example only, with reference to the attached figures.

DETAILED DESCRIPTION

Figure 1:
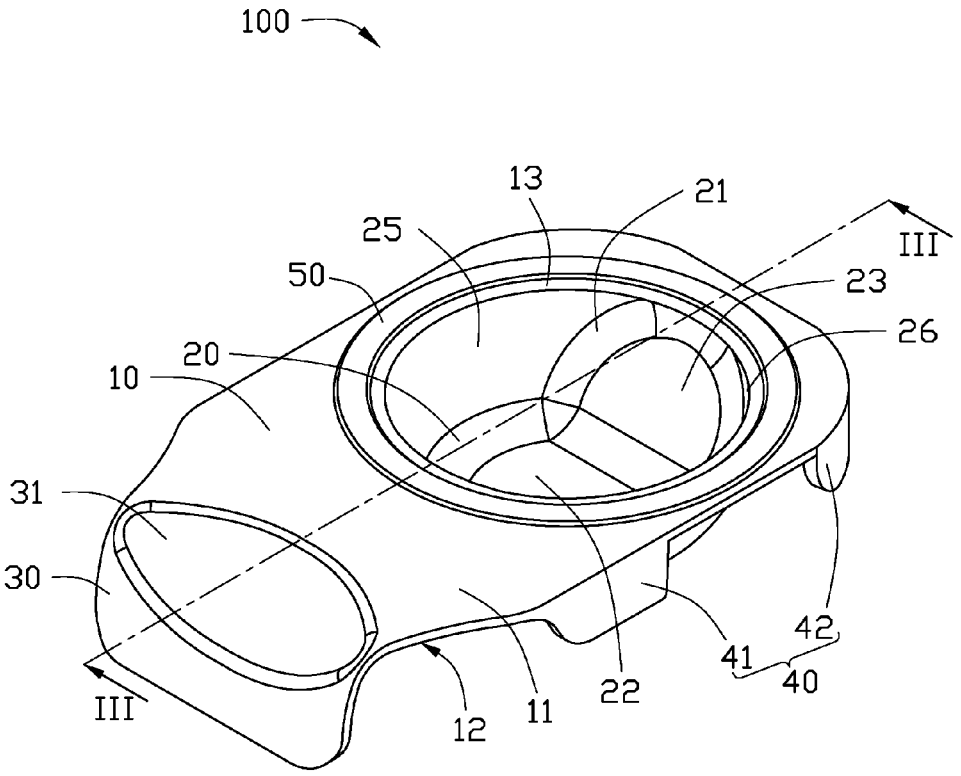
FIG. 1 is an isometric view of an embodiment of a contact lens package.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain sections have been exaggerated to better illustrate details and features of the present disclosure.

Several definitions that apply throughout this disclosure will now be presented.

The term "substantially" is defined to be essentially conforming to the dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a contact lens package. The contact lens package comprises a top plate, a receiving portion located at a first end of the top plate, and a holding portion located at a second end of the top plate opposite to the first end. The holding portion protrudes downward from the top plate. A holding surface is defined at an intersection of the holding portion and the top plate. The holding surface is an arc surface depressed from the intersection of the holding portion and the top plate.

FIG. 1 illustrates a contact lens package 100 of an embodiment. The contact lens package 100 includes a top plate 10, a receiving portion 20, a holding portion 30, a supporting portion 40, and a backing ring 50.

In one embodiment, the top plate 10 is substantially flat. The top plate 10 includes an upper surface 11 and an opposite lower surface 12. In one embodiment, the upper surface 11 are substantially parallel to the lower surface 12. An opening 13 is defined at an end of the top plate 10. The opening 13 penetrates through the upper surface 11 and lower surface 12.

Figure 2:
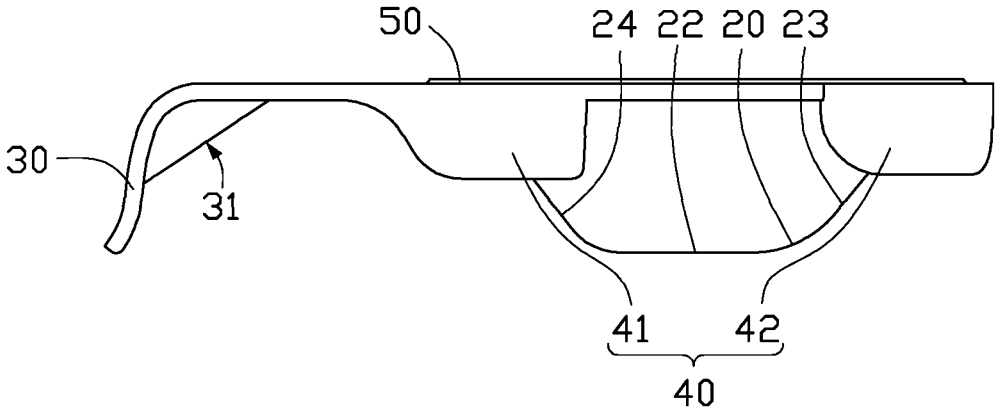
FIG. 2 is a side view of the contact lens package of FIG. 1.
Figure 3:
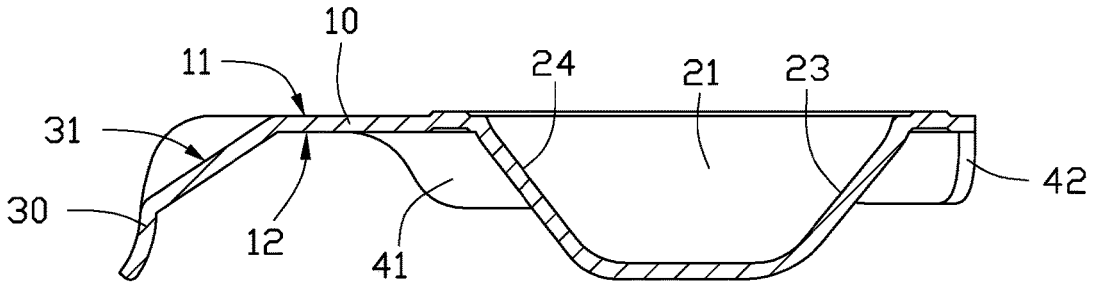
FIG. 3 is a cross sectional view taken along line I-I of FIG. 1.
Figure 4:
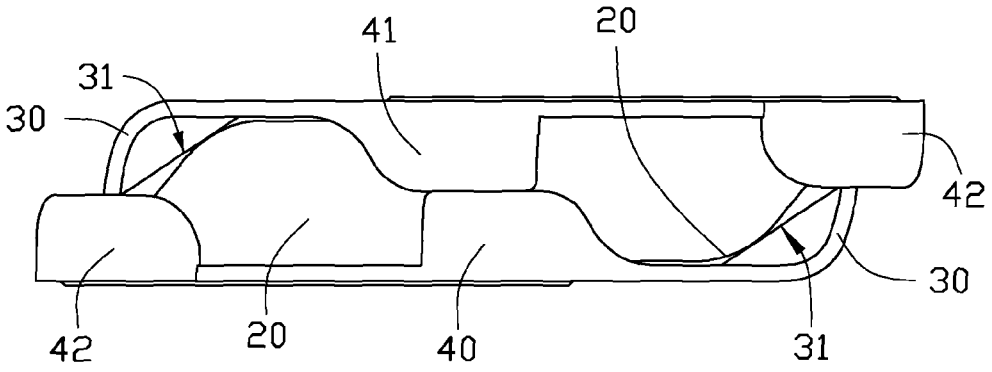
FIG. 4 is a side view showing two contact lens packages of FIG. 1 after being stacked.

FIGS. 1, 2, and 3 illustrate that the receiving portion 20 is located at an end of the top plate 10, and is aligned with the opening 13. The receiving portion 20 is configured to receive a contact lens (not shown) and a storage solution (not shown). The receiving portion 20 protrudes downward from the lower surface 12 of the top plate 10. In one embodiment, the receiving portion 20 is substantially bowl-shaped. A receiving groove 21 is defined in the receiving portion 20. In one embodiment, the receiving groove 21 corresponds to and is coupled with the opening 13. In one embodiment, the receiving portion 20 includes a bottom wall 22, a first side wall 23, a second side wall 24, a third side wall 25, and a fourth side wall 26. The first side wall 23, the third side wall 25, the second side wall 24, and the fourth side wall 26 are connect to each other in a written order, and are located between and connected to the bottom wall 22 and the top plate 10. The first side wall 23 is opposite to the second side wall 24. The third side wall 25 is opposite to the fourth side wall 26. The first side wall 23, the third side wall 25, the second side wall 24, the fourth side wall 26, and the bottom wall 21 cooperatively define the receiving groove 21. In one embodiment, each of the first side wall 23 and the second side wall 24 is substantially flat. Each of the third side wall 25 and the fourth side wall 26 is substantially arc-shaped. In one embodiment, each of an included angle between the first side wall 23 and the bottom wall 22 and an included angle between the second side wall 25 and the bottom wall 22 ranges from 100 to 140 degree. In one embodiment, the included angle between the first side wall 23 and the bottom wall 22 is greater than the included angle between the second side wall 25 and the bottom wall 22.

The holding portion 30 is located at another end of the top plate 10 opposite to the opening 13. The holding portion 30 protrudes downward from the top plate 10. In one embodiment, the holding portion 30 is substantially flat. An included angle between the holding portion 30 and the top plate 10 is not less than 90 degree. In one embodiment, the included angle between the holding portion 30 and the top plate 10 is greater than 90 degree. In one embodiment, an intersection of the holding portion 30 and the top plate 10 forms an arc-shaped transition extending from the holding portion 30 to the top plate 10. A holding surface 31 is defined at the intersection of the holding portion 30 and the top plate 10. In one embodiment, the holding surface 31 is an arc surface depressed from the intersection of the holding portion 30 and the top plate 10, thereby allowing a user to hold the contact lens package 100 more comfortably. A vertical height of the holding portion 30 can be greater than, equal to, or less than a vertical height of the receiving portion 20. In one embodiment, the vertical height of the holding portion 30 is substantially equal to the vertical height of the receiving portion 10.

The supporting portion 40 protrudes downward from the top plate 10 and surrounds the receiving portion 20. In one embodiment, the supporting portion 40 includes two first supporting arms 41 and a second supporting arm 42. The first supporting arms 41 are located on opposite sides of the receiving portion 20. The second supporting arm 42 is opposite to the holding portion 30. In one embodiment, the first supporting arms 41 and the second supporting arm 42 are spaced from each other. In one embodiment, a direction extending from the second supporting arm 42 to the holding portion 30 is substantially perpendicular to a direction extending from one of the first arm 41 to another first arm 41. Each of an included angle between each first supporting arm 41 and the top plate 10 and an included angle between the second supporting arm 41 and the top plate 10 is not less than 90 degree. In one embodiment, the included angles between each first supporting arm 41 and the top plate 10 and an included angle between the second supporting arm 41 and the top plate 10 are equal to 90 degree. In one embodiment, a vertical height of each first supporting arm 41 is substantially equal to a half of the vertical height of the holding portion 30. A vertical height of the second supporting arm 42 can be equal to or less than the vertical height of the holding portion 30.

In one embodiment, a width of the top plate 10 decreases along a direction from the first arms 41 to the holding portion 30 to form two smooth arc edges, thereby allowing the user to hold the contact lens package 100 more comfortably.

The backing ring 50 is located on the upper surface 11 of the top plate 10. The backing ring 50 corresponds to and surrounds the opening 13.

When two contact lens packages 100 are stacked, the top plate 10 of one contact lens package 100 is opposite to the top plate 10 of another contact lens package 100. The holding portion 30 of one contact lens package 100 contacts an inner side of the second supporting arm 42 of another contact lens package 100. A promote end of each first supporting arm 41 of one contact lens package 100 contacts a promote end of each first supporting arm 41 of another contact lens package 100. Therefore, a total volume of the two contact lens packages 100 after being stacked is decreased.

In other embodiment, the vertical height of each first supporting arm 41 and the vertical height of the second supporting arm 42 can be equal to the vertical height of the holding portion 30. In this embodiment, when the two contact lens packages 100 are stacked, the first supporting arms 41 of one contact lens package 100 can be staggered with the first supporting arms 41 of another contact lens package 100 and contact the lower surface of the top plate 10 of another contact lens package 100, therefore the total volume of the two contact lens packages 100 after being stacked can also be decreased.

In other embodiment, the contact lens package 100 further includes a cover film (not shown). The cover film is located on the backing ring 50 and seals the opening 13. The cover film is configured to prevent the contact lens and the care solution from spilling out of the receiving portion 20. In one embodiment, the cover film can be adhered to the backing ring 50.

The embodiments shown and described above are only examples. Many details are often found in the art such as the other features of a contact lens package. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the sections within the principles of the present disclosure, up to and including the full extent established by the broad general meaning of the terms used in the claims. It will therefore be appreciated that the embodiments described above may be modified within the scope of the claims.

What is claimed is:

1. A contact lens package comprising:

a top plate;

a receiving portion located at a first end of the top plate, a holding portion located at a second end of the top plate opposite to the first end; and a supporting portion protruding downward from the top plate and surrounding the receiving portion;

wherein the holding portion protrudes downward from the top plate, a holding surface is defined at an intersection of the holding portion and the top plate, and the holding surface is an arc surface depressed from the intersection of the holding portion and the top plate;

wherein the supporting portion comprises two first supporting arms, the two first supporting arms are located at opposite sides of the receiving portion, and the two first supporting arms are spaced from the holding portion; and wherein a vertical height of each first supporting arm is equal to half of a vertical height of the holding portion.

2. The contact lens package of claim 1, wherein the receiving portion is bowl-shaped, a receiving groove is defined in the receiving portion.

3. The contact lens package of claim 2, wherein the receiving portion includes a bottom wall, a first side wall, a second side wall, a third side wall, and a fourth side wall, the first side wall, the third side wall, the second side wall, and the fourth side wall are connected with each other in written order and are interconnected between the bottom wall and the top plate, the first side wall is opposite to the third side wall, and the third side wall is opposite to the fourth side wall.

4. The contact lens package of claim 3, wherein the bottom wall and the first and second side walls are flat-shaped.

5. The contact lens package of claim 4, wherein each of an included angle between the first side wall and the bottom wall and an included angle between the second side wall and the bottom wall ranges from 100 to 140 degree.

6. The contact lens package of claim 4, wherein an included angle between the first side wall and the bottom wall is greater than an included angle between the second side wall and the bottom wall.

7. The contact lens package of claim 4, wherein the third and fourth side walls are arc-shaped.

8. The contact lens package of claim 1, wherein a width of the top plate decreases along a direction from the two first supporting arms to the holding portion.

9. The contact lens package of claim 1, wherein the supporting portion further comprises a second supporting arm, the second supporting arm is located at the first end of the top plate and is opposite to the holding portion.

10. The contact lens package of claim 9, wherein a vertical height of the second supporting arm is equal to or less than a vertical height of the holding portion.

11. The contact lens package of claim 1, further comprising a backing ring, wherein the backing ring is located on an upper surface of the top plate, the top plate defines an opening coupled with the receiving portion, and the backing ring surrounds the opening.

* * * * *